United States Patent [19]

Reopelle

[11] Patent Number: 5,044,355

[45] Date of Patent: Sep. 3, 1991

[54] RECIPROCATING LEG EXERCISE APPARATUS WITH GEAR ASSEMBLY

[76] Inventor: Lawrence E. Reopelle, Rhinehart Dr., E. Grand Forks, Minn. 56721

[21] Appl. No.: 512,372

[22] Filed: Apr. 23, 1990

[51] Int. Cl.[5] ..... A61H 1/02; A63B 23/04

[52] U.S. Cl. ..... 128/25 B; 272/96; 272/126

[58] Field of Search ..... 128/25 R, 25 B, 51, 128/57; 272/96, 126, 131, 67

[56] References Cited

U.S. PATENT DOCUMENTS

| | | | |
|---|---|---|---|
| 1,982,843 | 12/1934 | Traver | 128/25 R |
| 2,307,856 | 1/1943 | Porter | 272/131 |
| 3,749,400 | 7/1973 | Stoffel | 272/96 X |
| 3,824,994 | 7/1974 | Soderberg, Sr. | 128/25 R |
| 3,982,757 | 9/1976 | McDonnell | 272/67 X |
| 4,229,001 | 10/1980 | Roman | 272/96 |
| 4,550,908 | 11/1985 | Dixon | 272/96 X |
| 4,618,139 | 10/1986 | Haaheim | 272/126 X |
| 4,665,899 | 5/1987 | Farris et al. | 128/25 R |
| 4,922,892 | 5/1990 | Akcelrod et al. | 128/25 R |
| 4,960,276 | 10/1990 | Feuer et al. | 128/25 R X |

FOREIGN PATENT DOCUMENTS

| | | | |
|---|---|---|---|
| 540433 | 5/1957 | Canada | 272/96 |
| 0640740 | 1/1979 | U.S.S.R. | 128/25 R |

*Primary Examiner*—Robert Bahr
*Assistant Examiner*—Linda C. M. Dvorak
*Attorney, Agent, or Firm*—Leon Gilden

[57] ABSTRACT

An exercise apparatus for physical therapy subsequent to knee injury and/or surgery, including a plurality of concave "J" shaped supports reciprocatingly and slidably mounted within an underlying support base. The support base includes an aligned row of equally spaced rotatable gears, wherein each of the "J" shaped supports includes a linear gear rack cooperative with the rotatable gears to permit reciprocation and cooperation of the organization in use to maintain alignment with the support base.

7 Claims, 7 Drawing Sheets

PRIOR ART

Fig 5
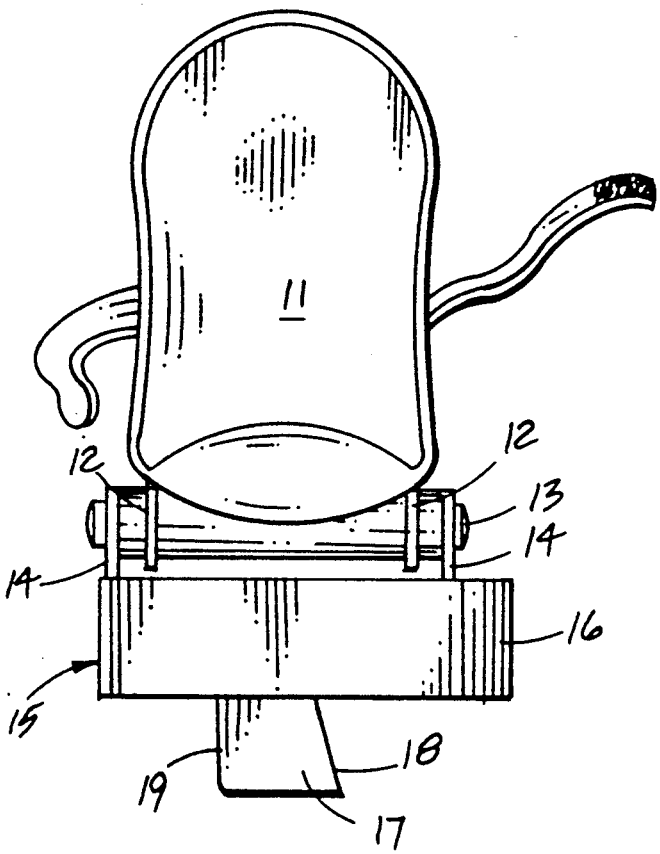
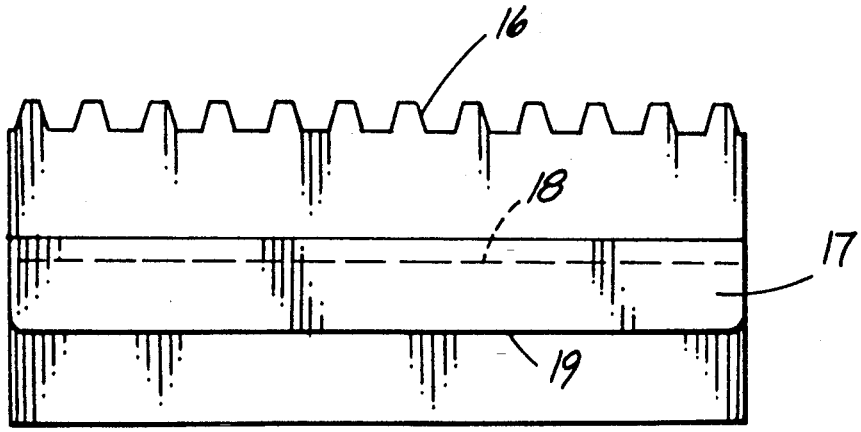
Fig 6

31
10a
11a
15a
23
16a
21
20
27a
27
23
16
11
15
9
9
21
20
31
30

31
32
30
29
29a
17a
23
27
28
17
16a
28a
27a
16
22
18
24
18a

Fig 10
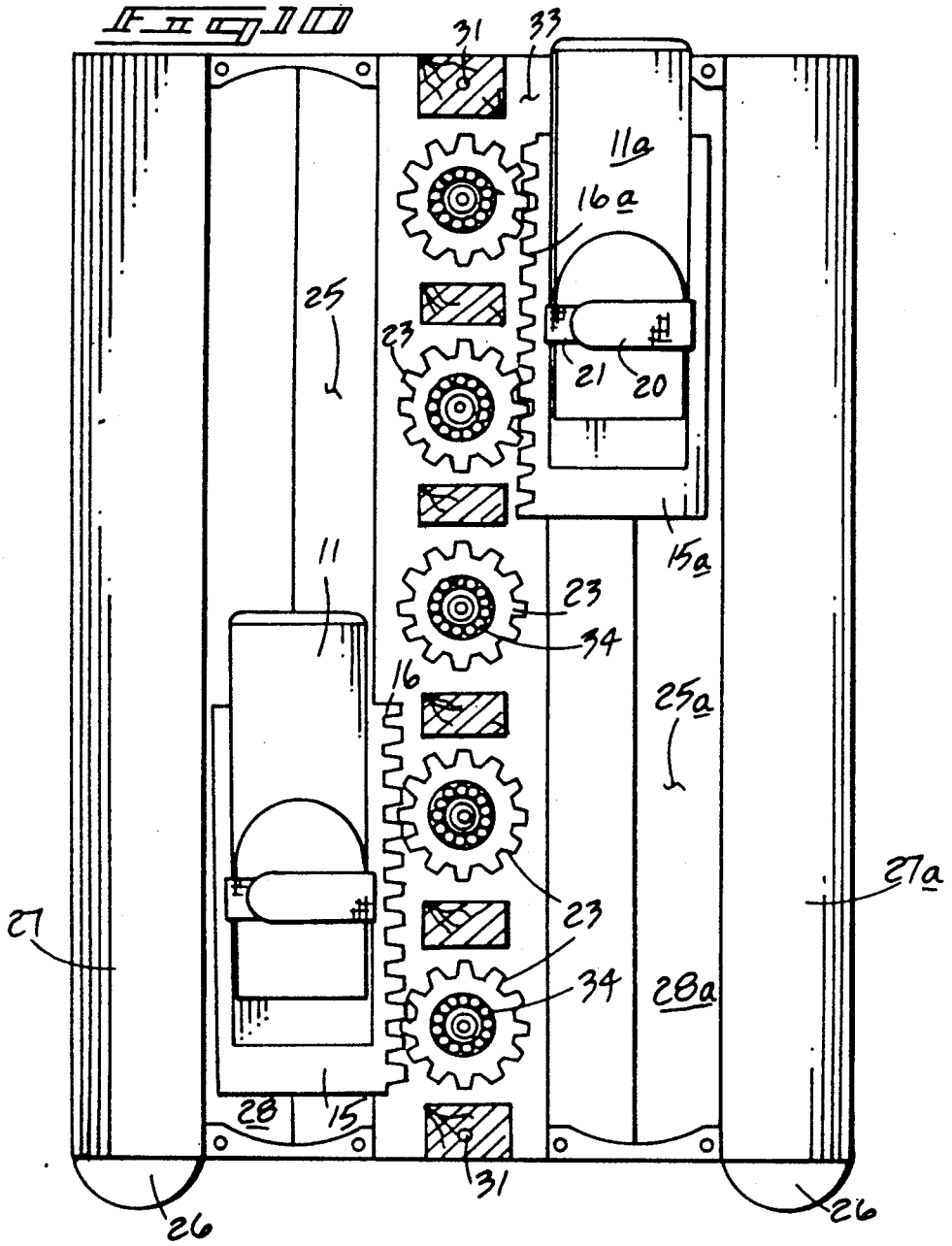
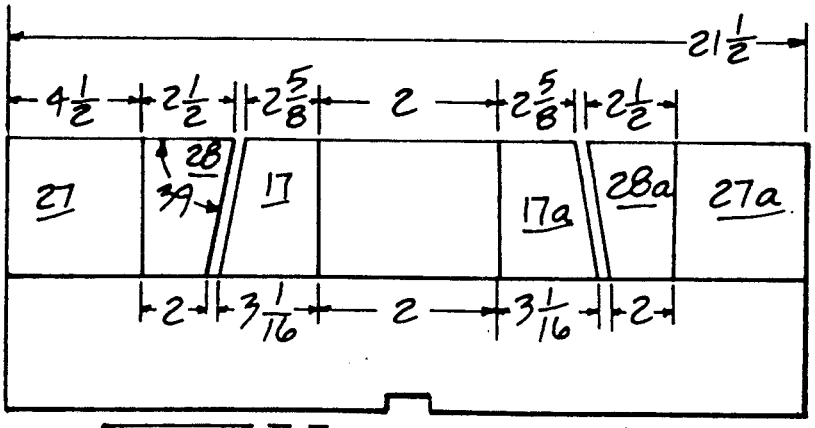
Fig 11

RECIPROCATING LEG EXERCISE APPARATUS WITH GEAR ASSEMBLY

BACKGROUND OF THE INVENTION

1. Field of the Invention

The field of invention relates to exercise apparatus, and more particularly pertains to a new and improved therapeutic exercise apparatus wherein the same is directed to enhance flexibility and exercise of a knee joint subsequent to surgery. The organization permits the selective bending of an injured knee in particularly those patients provided with knee replacements.

2. Description of the Prior Art

Various therapeutic and convalescent type apparatus is provided in the prior art to assist patients subsequent to surgery and/or injury relative to discrete portions of the human anatomy. Prior art examples may be found in U.S. Pat. No. 4,844,454 to Rogers wherein a portable manually operatable knee exerciser permits selective flexure of a knee relative to a thigh, wherein the organization is strapped to a thigh portion and a lever is pivoted relative to the thigh portion to permit flexure of the knee.

U.S. Pat. No. 4,825,852 to Genovese, et al. provides a passive motion device wherein one of a plurality of legs are mounted within the organization that are driven by a drive mechanism to effect flexure of knee joint portions of the individual's legs.

U.S. Pat. No. 4,784,121 to Brooks provides a knee exercising device wherein a pivot member is positioned rearwardly of an ankle and pivoted to effect movement of the ankle relative to an individual's thigh.

U.S. Pat. No. 4,665,899 to Farris, et al. provides a carriage to mount an individual's leg therewithin and effect flexure of the leg relative to a thigh portion of the individual utilizing an electric drive motor to effect relative motion of the carriage.

As such, it may be appreciated that there continues to be a need for a new and improved exerciser apparatus as set forth by the instant invention which addresses both the problems of ease of use, as well as effectiveness in construction in therapeutic exercise of a knee joint subsequent to surgery and/or injury and in this respect, the instant invention substantially fulfills this need.

SUMMARY OF THE INVENTION

In view of the foregoing disadvantages inherent in the known types of therapeutic exercise apparatus now present in the prior art, the present invention provides an exercise apparatus wherein the same permits selective and balanced exercise of an injured knee joint utilizing an opposing knee to counter-balance motion during movement of the damaged knee joint relative to an individual's body. As such, the general purpose of the present invention, which will be described subsequently in greater detail, is to provide a new and improved exercise apparatus which has all the advantages of the prior art therapeutic exercise apparatus and none of the disadvantages.

To attain this, the present invention provides an exercise apparatus for physical therapy subsequent to knee injury and/or surgery, including a plurality of concave "J" shaped supports reciprocatingly and slidably mounted within an underlying support base. The support base includes an aligned row of equally spaced rotatable gears, wherein each of the "J" shaped supports includes a linear gear rack cooperative with the rotatable gears to permit reciprocation and cooperation of the organization in use to maintain alignment with the support base.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved exercise apparatus which has all the advantages of the prior art exercise apparatus and none of the disadvantages.

It is another object of the present invention to provide a new and improved exercise apparatus which may be easily and efficiently manufactured and marketed.

If is a further object of the present invention to provide a new and improved exercise apparatus which is of a durable and reliable construction.

An even further object of the present invention is to provide a new and improved exercise apparatus which is susceptible of a low cost of manufacture with regard to both materials and labor, and which accordingly is then susceptible of low prices of sale to the consuming public, thereby making such exercise apparatus economically available to the buying public.

Still yet another object of the present invention is to provide a new and improved exercise apparatus which provides in the apparatuses and methods of the prior art some of the advantages thereof, while simultaneously overcoming some of the disadvantages normally associated therewith.

Still another object of the present invention is to provide a new and improved exercise apparatus wherein the same permits precision motion of a damaged knee joint utilizing an opposing knee joint of an inidvidual as a counter-balance force in exercise and flexure of the damaged knee.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an orthographic front view, taken in elevation, of the foot support of the instant invention.

FIG. 6 is an orthographic bottom view of the foot support of the instant invention.

FIG. 10 is an orthographic top view of the instant invention with the guard structure removed therefrom.

FIG. 11 is an orthographic view, taken in elevation, of a diagrammatic geometric relationship of the variously movable components relative to one another.

DESCRIPTION OF THE PREFERRED EMBODIMENT

Figure 1:
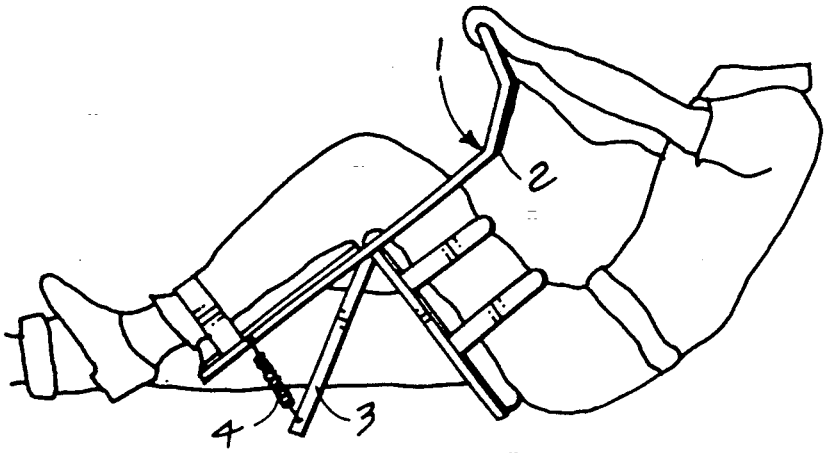
FIG. 1 is an orthographic view of a prior art knee joint exercise apparatus.

With reference now to the drawings, and in particular to FIGS. 1 to 13 thereof, a new and improved exercise apparatus embodying the principles and concepts of the present invention and generally designated by the reference numeral 10 will be described.

Figure 2:
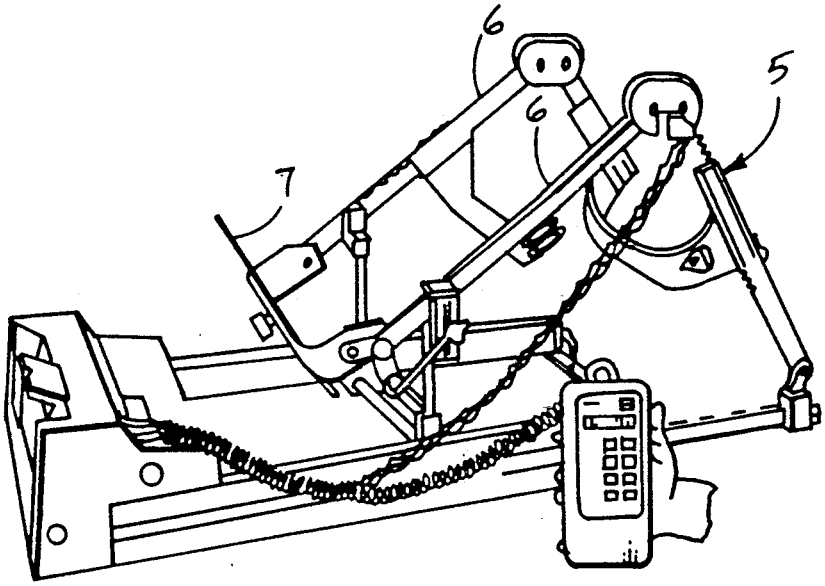
PRIOR ART FIG 2
FIG. 2 is an isometric prior art illustration of a passive exercise apparatus for exercising damaged knee joint portions of the human anatomy.

FIG. 1 illustrates a prior art knee exercise apparatus 1, wherein a pivot structure 2 is pivotal relative to a knee brace about a support leg 3 utilizing a biasing spring 4 to return the organization to an initial position. FIG. 2 illustrates a prior art passive knee exericise apparatus 5, wherein leg supports 6 are cooperative with a foot rest portion 7 to reciprocate relative to a carriage to permit flexure relative to a knee joint in therapeutic exercise thereof.

Figure 3:
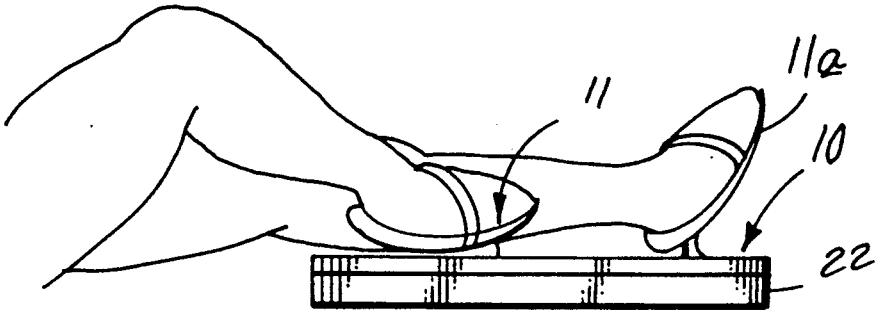
FIG. 3 is an orthographic side view, taken in elevation, of the instant invention secured to an individual.
Figure 4:
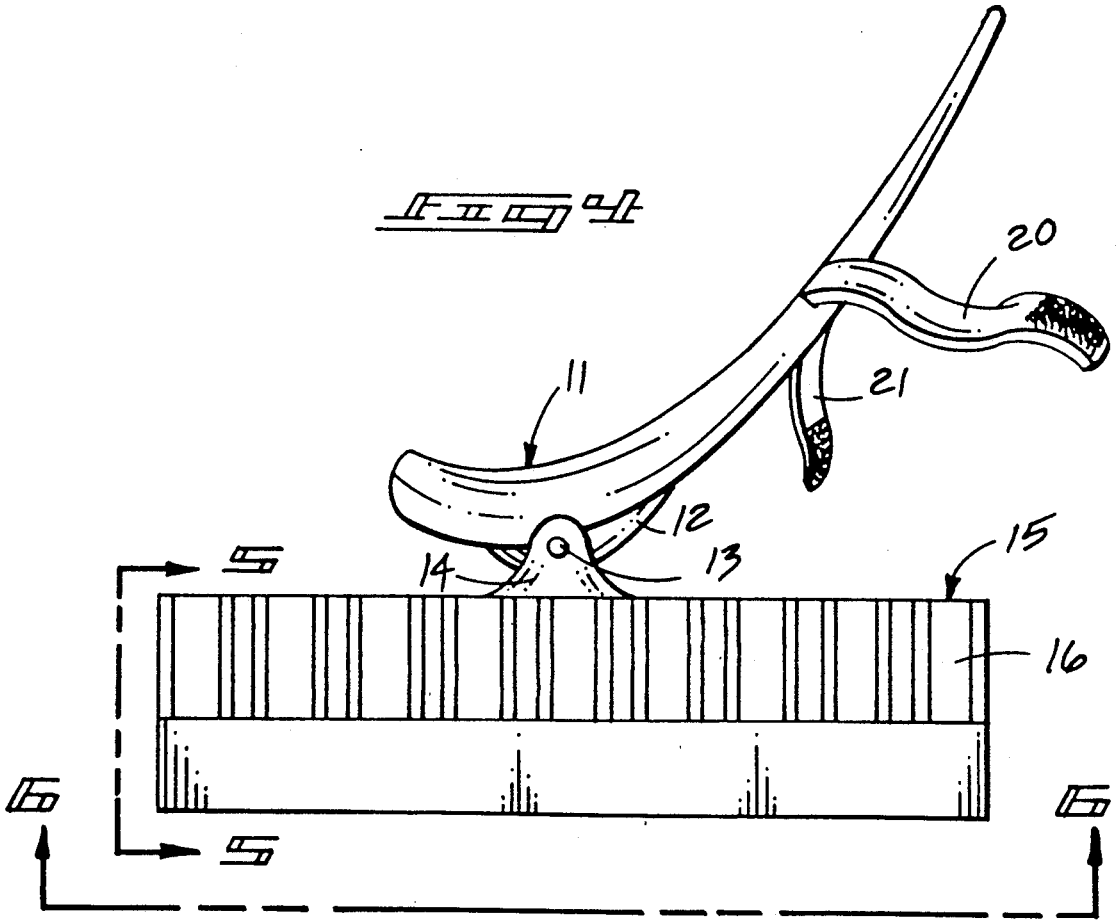
FIG. 4 is an orthographic side view, taken in elevation, of the foot support utilized by the instant invention.
Figure 7:
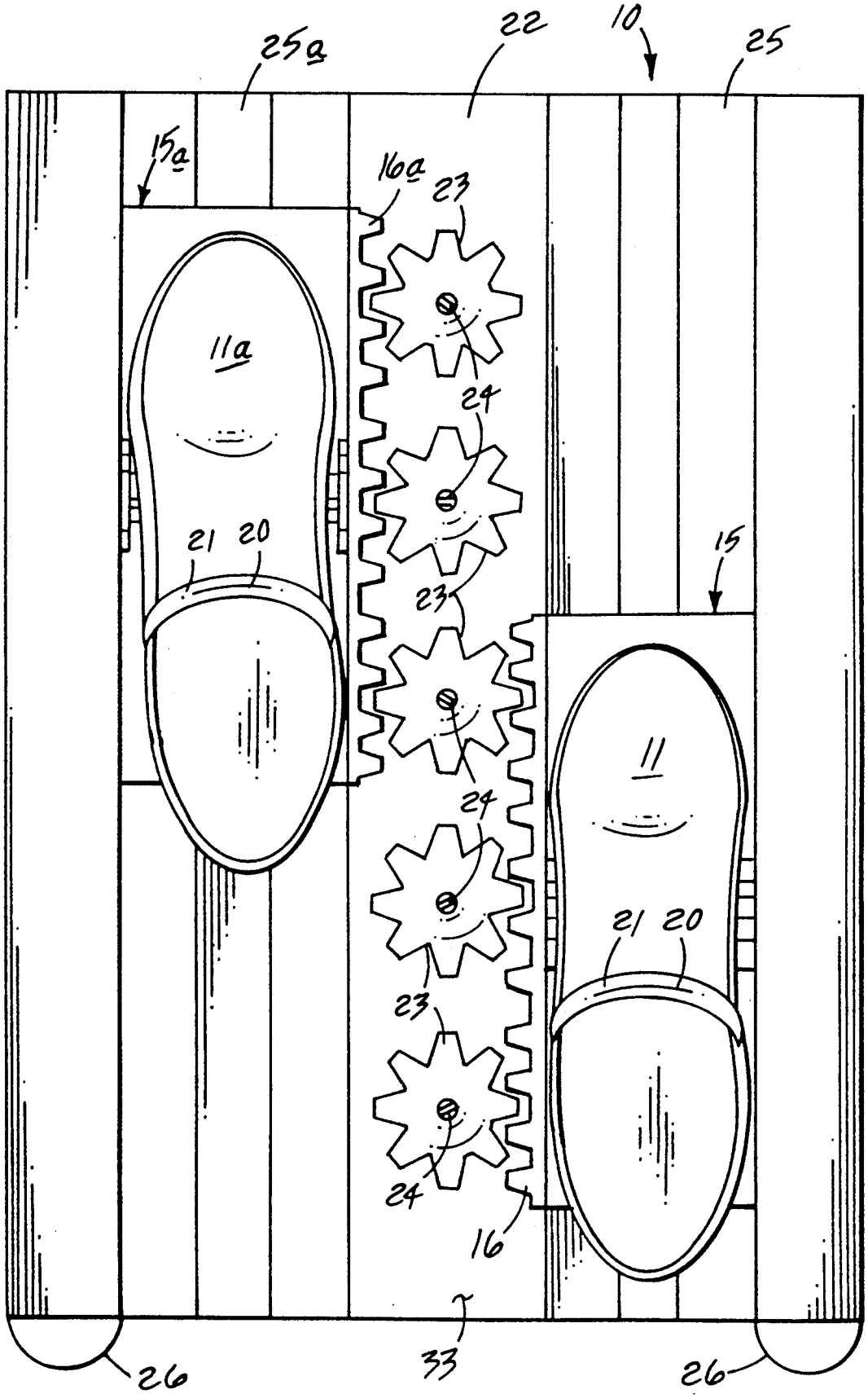
FIG. 7 is an orthographic view of the right and left foot supports utilized in combination with the support platform of the instant invention.
Figure 8:
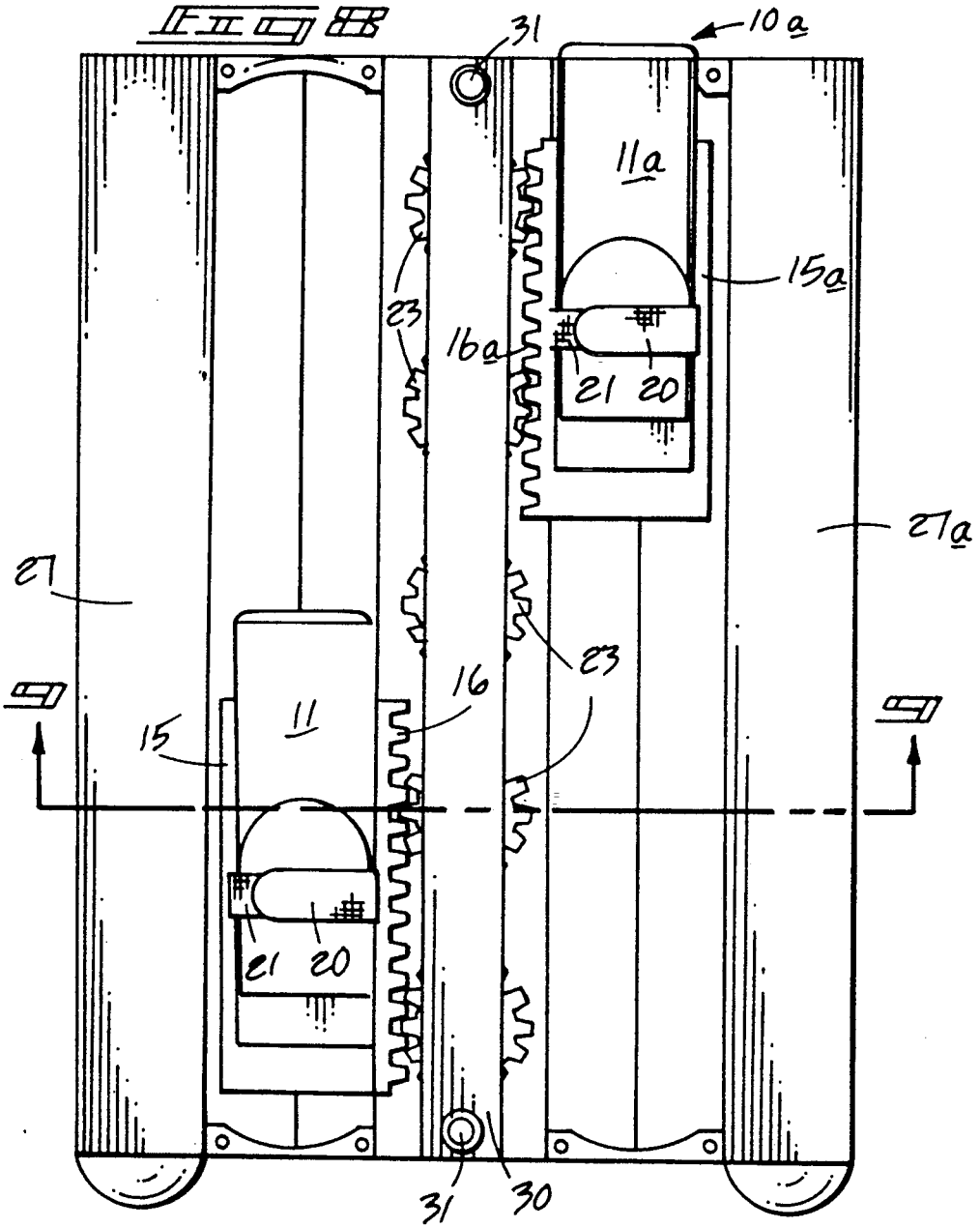
FIG. 8 is an orthographic top view of the instant invention utilizing a cover guard overlying the gear portions of the instant invention.
Figure 9:
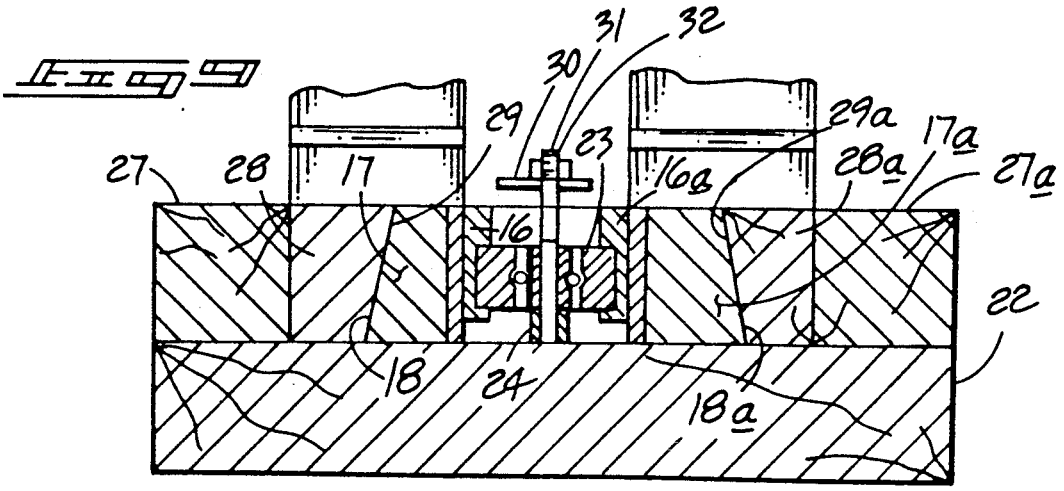
FIG. 9 is an orthographic view, taken along the lines 9—9 of FIG. 8, in the direction indicated by the arrows.
Figure 12:
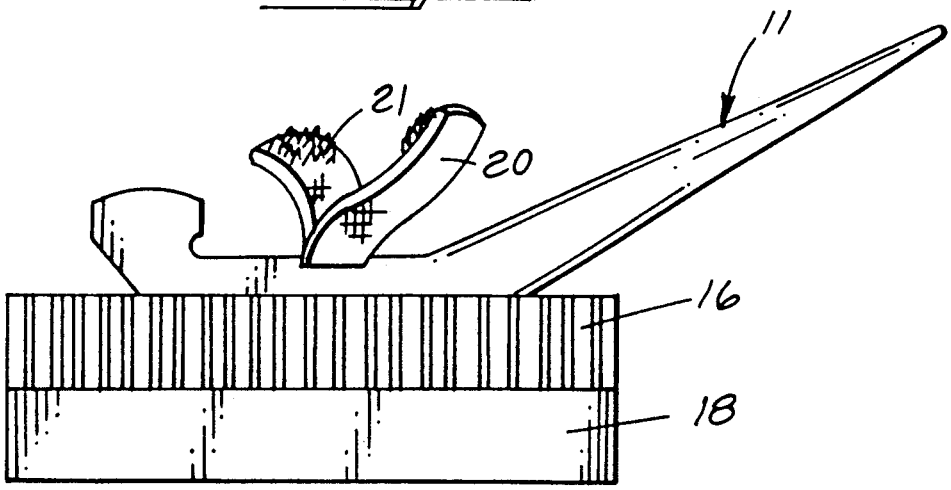
FIG. 12 is an orthographic side view, taken in elevation, of a further configuration of the foot support structure of the instant invention.

More specifically, the exercise apparatus 10 of the instant invention comprises a right and left foot support 11 and **11*a* slidably mounted upon an underlying base support 22. Each foot support is formed as a concave "J" shaped member inclined rearwardly, including a plurality of foot support flanges spaced apart and parallel relative to one another and orthogonally mounted relative to a bottom surface of the foot support structure, wherein the foot support flanges are cooperative with a plurality of spaced parallel support boss plates 14 orthogonally mounted upon respective right and left reciprocable blocks 15 and 15*a*, as illustrated in FIGS. 4 and 7 for example. A pivot axle 13 is orthogonally directed through the foot support flanges 12 and the support boss plates 14 to permit pivoting of each foot support relative to an underlying reciprocable block. The base support 22 includes a central gear channel 33 directed medially and longitudinally of the base support 22, wherein each respective right and left reciprocable block 15 and 15*a* include a respective right and left linear gear rack 16 and 16*a* formed to an interior side wall of each respective reciprocable block 15 and 15*a* directed interiorly towards the gear channel 33 of the base support 22, as illustrated in FIGS. 7 and 8 for example. The bottom surface of each reciprocable block 15 includes a locking boss 17 fixedly mounted to and coextensively formed longitudinally of the bottom surface of each reciprocable block. Each locking boss 17 includes a beveled interior wall 18 inclined outwardly from the reciprocable block 15 downwardly and outwardly to a bottom surface of each locking boss 17. Each locking boss 17 further includes a vertical exterior wall 19 arranged orthogonally relative to the bottom surface of each associated reciprocable block. The beveled interior wall 18 of the right reciprocable block 15 includes a mirror image beveled interior wall 18*a* associated with a companion left locking boss 17*a* formed to the left reciprocable block 15, as illustrated in FIG. 9 for example. Further, each right and left foot support 11 and 11*a* includes a plurality of flexible straps defined by a respective first and second flexible strap 20 and 21, each including a cooperating hook and loop fastener surface to permit selective securement of an individual's foot and capture the foot within an associated foot support in a manner as illustrated in FIG. 3**.

Figure 13:
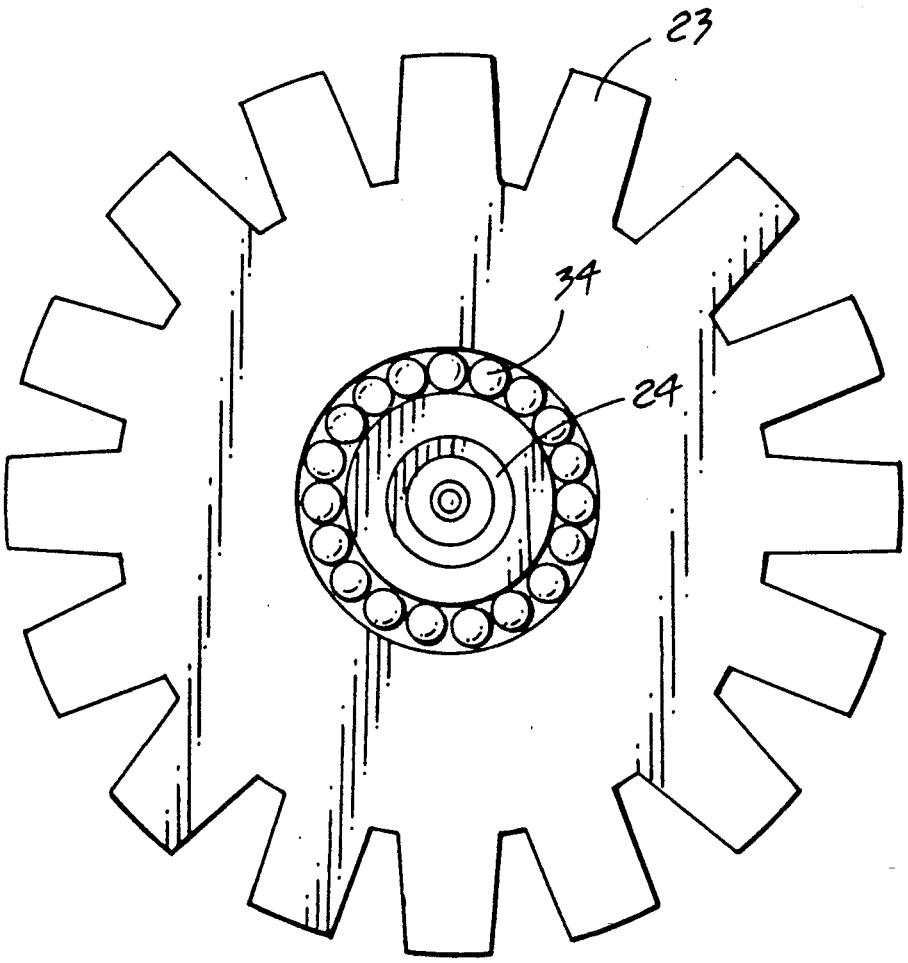
FIG. 13 is an orthographic top view of a rotary gear structure utilized by the instant invention.

The respective right and left linear gear racks 16 and **16*a* cooperate with a series of equally spaced rotary gears 23 orthogonally mounted to a top surface of the base support 22 within the gear channel 33. The gear channel 33 is defined by a predetermined width greater than that of a predetermined diameter defined by each of the gears 23. Each of the gears 23 are rotatably mounted about a respective gear post 24 that captures a gear roller bearing 34 between each post 24 and the associated rotary gear 23, as illustrated in FIG. 13. In the embodiment as illustrated in FIG. 7, each of the respective linear racks 16 and 16*a* are in relative relationship to one another, and each cooperate with three of six rotary gears 23 mounted within the gear channel 33 to effect stability of the reciprocable blocks during sliding reciprocation on the base support 22**.

The modified base support structure illustrated in FIGS. 8 and 10 illustrates an improved relationship of the respective right and left linear gear racks 16 and **16*a* with the rotary gears 23, wherein the gear racks are defined by a predetermined length substantially equal to 1.5 times the spacing between adjacent gears to effect continuous contact with a respective gear rack 16 or 16*a* with a plurality of gears, i.e. two gears, during reciprocation of the respective reciprocable blocks 15 overlying the base support 22 in respective right and left slots 25 and 25*a***.

Respectively right and left side bars 27 and **27*a* are fixedly mounted coextensively with opposed right and left sides of the base support 22 and position respective right and left block supports 28 and 28***a* interiorly thereof, wherein each block support 28 and 28*a* includes a respective right and left beveled interior wall, each arranged at an acute angle relative to the planar support 22 to thereby capture an associated right and left locking boss 17 of each respective reciprocable block between the gears 23 and the block supports, as illustrated in FIGS. 9 and 11 for example. Further it should be noted that an elongate shield 30 is longitudinally aligned with and overlies each of the rotary gears 23 and is coextensively formed in length relative to the length of the support base 22. The shield 30 is mounted and captured to shield bosses 31 that are fixedly mounted to the support base 22 and include boss securement fasteners 32 mounted to each boss 31 to secure the shield 30 overlying the gears 23, as illustrated.

In this manner, an individual upon securing both feet into the respective right and left foot supports 11 and 11*a* is permitted ease of reciprocation of the individual's knees dependent upon the flexure available to that individual subsequent to treatment, such as surgery. The individual may utilize available hip muscles to offset limited knee strength in reciprocation fo the individual's feet within the organization.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An exercise apparatus for therapeutic stretching of an individual's knee joint, wherein the apparatus comprises, an elongate planar support base, the planar support base including a planar top surface, a gear channel defined medially and longitudinally of the planar top surface, the gear channel defined by a predetermined width, a plurality of rotary gears spaced at a predetermined equal spacing relative to one another within the gear channel, a right and left block support formed longitudinally of and equally spaced from the rotary gears, and a respective right and left foot support means captured between a respective right and left block support and the rotary gears for permitting reciprocation of the right and left foot support means overlying the planar top surface of the planar support base.

2. An apparatus as set forth in claim 1 wherein each respective right and left foot support means includes a respective right and left foot support defined as a concave "J" shaped member, wherein each concave "J" shaped member includes a first and second flexible strap, and each flexible strap includes a respective first and second hook and loop fastener portion to secure each respective first and second strap together.

3. An apparatus as set forth in claim 2 wherein each respective right and left foot support includes a plurality of spaced parallel foot support flanges fixedly and orthogonally mounted to a bottom surface of each respective right and left foot support, and the right and left foot support flanges each cooperate with respective pairs of right and left support boss plates, and a respective right and left pivot axle directed through each of the pairs of right and left foot support boss plates and the respective right and left foot support flanges, and each of the pairs of respective right and left support boss plates are fixedly and orthogonally mounted onto a respective right and left reciprocatable block, wherein each right and left reciprocable block includes a respective right and left linear gear rack.

4. An apparatus as set forth in claim 3 wherein each respective right and left linear gear rack is in engagement with a plurality of rotary gears, and each right and left gear rack is spaced relative to one another vertically and longitudinally on the planar top surface of the planar support base.

5. An apparatus as set forth in claim 4 wherein each right and left reciprocable block includes a respective right and left trapezoidal locking boss fixedly mounted to a bottom surface of each reciprocable block, each trapezoidal locking boss in sliding engagement with the planar top surface of the support base.

6. An apparatus as set forth in claim 5 wherein each respective right and left locking boss includes a respective beveled right and left interior boss wall, each beveled interior boss wall cooperates with each respective right and left block support, and each block support includes a respective right and left beveled block support wall, wherein each right and left beveled block support wall is arranged at an acute included angle between the respective right and left block support wall and the planar top surface of the planar support base.

7. An apparatus as set forth in claim 6 wherein each respective right and left linear rack is defined by a predetermined length, and each predetermined length is defined by a distance less than that defined between three of the plurality of rotary gears, and wherein at least four rotary gears are utilized to define the plurality of rotary gears.

* * * * *